United States Patent [19]

Bileski et al.

[11] 4,121,073

[45] Oct. 17, 1978

[54] CONDITION RESPONSIVE ELECTRICAL SWITCH HAVING IMPROVED BRIDGING CONTACT MEANS

[75] Inventors: Thomas Bileski; Joe W. Crawford, both of Dallas; Bobby D. Blanton, Seagoville; Carl N. Johnson, Dallas; Felix Garcia, Garland; John W. Orcutt, Garland; Glen C. Shepherd, Garland; James A. Oursler, Dallas, all of Tex.

[73] Assignee: Texas Instruments Incorporated, Dallas, Tex.

[21] Appl. No.: 772,701

[22] Filed: Feb. 28, 1977

[51] Int. Cl.[2] ..... H01H 35/34

[52] U.S. Cl. ..... 200/83 P; 200/243; 200/275

[58] Field of Search ..... 200/83 P, 67 DA, 67 DB, 200/76, 159 B, 241, 243, 242, 275

[56] References Cited

U.S. PATENT DOCUMENTS

| | | | |
|---|---|---|---|
| 3,378,656 | 4/1968 | Johnson | 200/83 P |
| 3,876,845 | 4/1975 | Griffith | 200/83 P |
| 3,941,964 | 3/1976 | Yoder | 200/275 |

*Primary Examiner*—Gerald P. Tolin

*Attorney, Agent, or Firm*—John A. Haug; James P. McAndrews

[57] ABSTRACT

An electrical switch actuatable upon the occurrence of a preselected level, includes a generally cup shaped, open ended housing which mounts therein a spaced pair of stationary contacts. The housing has two pairs of upwardly extending channels in its side walls, the two channels of the first pair aligned with the stationary contacts and the two channels of the second pair aligned with platform surfaces. An electrically conductive, flexible cruciform element is disposed in the housing with the distal end portions of two legs of the cruciform received respectively in the two channels of the first pair, and the distal end portions of the other two legs of the cruciform received respectively in the two channels of the second pair and resting on the platform surfaces. The stationary contacts may be disposed above or beneath the cruciform element for a normally open or normally closed switch as desired. The stationary contacts may lie in a plane parallel to the plane of the snap acting member or in planes which intersect each other and the plane of the snap acting member. A motion transfer pin extends between the snap acting member and the cruciform element and may be provided with a shoulder to prevent overtravel of the pin.

14 Claims, 6 Drawing Figures

CONDITION RESPONSIVE ELECTRICAL SWITCH HAVING IMPROVED BRIDGING CONTACT MEANS

This invention relates generaly to condition responsive electrical switches and more specifically to pressure responsive electrical switches. Such switches are disclosed and claimed in coassigned U.S. Pat. No. 3,584,168 which issued June 8, 1971. Generally, such switches include an open ended cup shaped housing in which a switch assembly is mounted comprising a pair of terminals extending through apertures in the housing walls, a stationary contact mounted on one of the terminals and a cantilever supported, flexible contact arm mounting at its distal end a movable contact which is adapted to move into portions of engagement and disengagement with the stationary contact. The contact arm is prebiased at its fixed end toward one of the above positions. A snap acting member is received at and closes the open end of the housing. A motion transfer pin is disposed between one side of the snap acting member and the contact arm while a port fitting is disposed at the opposite side of the snap acting member so that a pressure source can be communicated to the opposite side of the member.

Such devices have proven to be very successful since they are relatively inexpensive yet are highly reliable in many applications. However with the ubiquitousness today of automotive air conditioning a new need has arisen which the above described switch cannot meet. In such air conditioning systems it is necessary to control evaporator temperature which can be accomplished by controlling the evaporator pressure due to the existing temperature-pressure relationship, an application requiring a life expectancy of 250,000 cycles or more. However in such an application, which also involves high pressure differentials, the impact forces on the contact arm occasioned by the snapping of the snap acting member are of such a magnitude that life expectancy of the switch is only in the order of 100,000 cycles at which time metal fatique in the cantilever mounted contact arm results in switch failure.

Among the objects of the present invention, therefore, are the provisions of a pressure responsive electrical switch having improved life expectancy, a switch which is inexpensive yet reliable, a switch in which contact contamination is minimized and a switch which is particularly adapted to withstand high energy impact forces occasioned by high pressure differential switching. Other objects and features will be in part apparent and in part pointed out hereinafter.

Briefly, a condition responsive electrical switch made in accordance with this invention comprises a housing mounting a pair of spaced stationary contacts and an electrically conductive, flexible cruciform element having the distal end portions of two of its legs aligned with and adapated to move into positions of engagement and disengagement with the stationary contacts and the distal end portions of its other two legs reacting against portions of the housing so that the first two legs are biased toward one of their two positions. A snap acting member is mounted on the housing and motion transfer pin is disposed between the snap acting member and the cruciform element so that snapping of the snap acting member upon occurrence of a predetermined condition will cause the motion transfer pin to move and force the first two legs of the cruciform element into their other position. The stationary contacts can be disposed beneath or above the cruciform for a normally opened, close on pressure rise switch or normally closed, open on pressure rise switch. The stationary contacts may lie in a plane parallel to the plane of the snap acting member or they may lie in planes which intersect each other and the plane of the snap acting member to optimize contact wiping. In several embodiments contact contamination is minimized by providing contact wiping by bending the cruciform element so that its legs are at an angle to its main body portion. The motion transfer pin may be provided with a shoulder to prevent overtravel.

For the purpose of facilitating an understnading of the invention several preferred embodiments have been illustrated in the accompanying drawings, form an inspection of which, when considered in connection with the following description, the invention, its mode of construction, assembly and operation, and many of its advantages should be readily understood and appreciated.

Referring to the drawings in which the same characters of reference are employed to indicate corresponding or similar parts throughout the several figures of the drawings.

Figure 1:
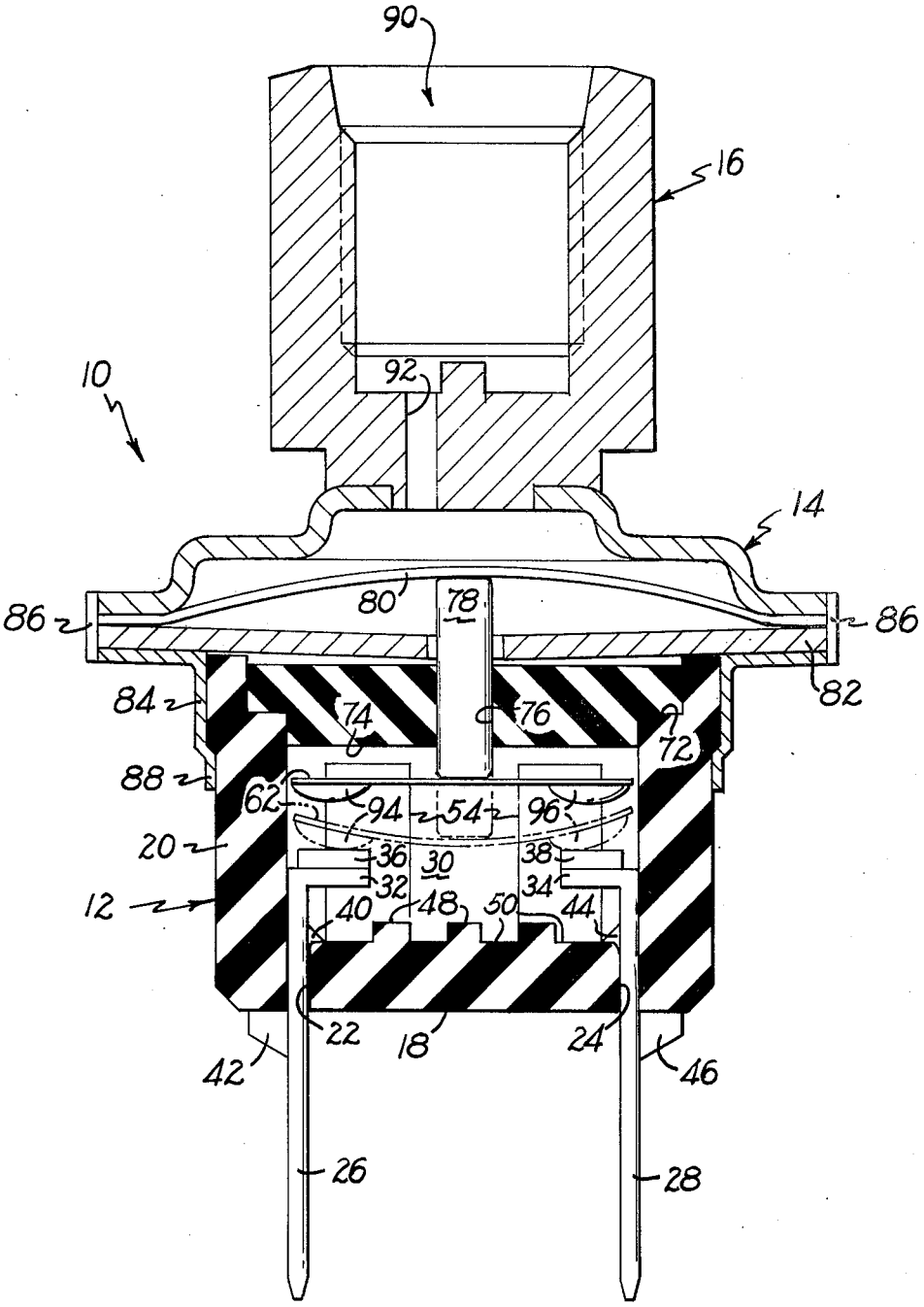
FIG. 1 is a vertical cross sectional view of a condition responsive electrical switch made in accordance with the invention.
Figure 2:
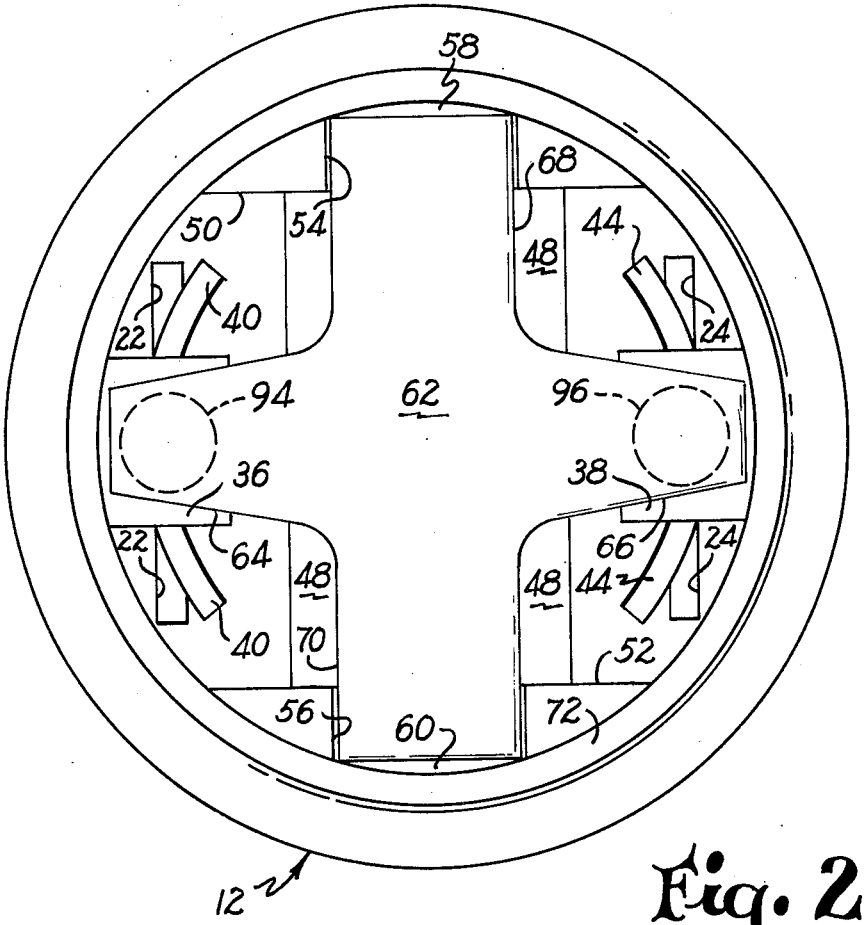
FIG. 2 is a top plan view of the base housing portion of the FIG. 1 swithc with the condition actuating mechanism removed for the purpose of illustration.

Referring now to FIGS. 1 and 2 reference numeral 10 indicates a condition responsive electrical switch comprising a base housing 12, a snap acting member housing 14 and a port fitting 16.

Base housing 12 is a generally cylindrical, cup shaped open ended housing with a bottom wall 18 and a side wall 20 extending upwardly therefrom. Housing 12 may be formed of any good electrically insulative material such as a resinous material. A spaced pair of apertures 22,24 are provided in bottom wall 18 which accomodate respective terminals 26,28 which extend into a switch cavity 30 formed in housing 12. One end of terminals 26,28 are conveniently bayonet configured, however other terminal ending configurations could be employed if preferred. The opposite ends of terminals 26,28 disposed inside of switch cavity 30 are formed with respective tab portions 32,34 on which are mounted respective stationary electrical contacts 36,38 preferably formed of highly electrically conductive material such as a silver alloy. Tab portions 40,42 are bent from the main body portion of terminal 26 to maintain the terminal at a selected fixed position relative to housing 12. In like manner tabs 44 and 46 are bent from the main body portion of terminal 28 to maintain it in a selected fixed location. A series of lands 48 and grooves 50 may be provided in the bottom wall of housing 12 to provide arc shadow and prevent tracking from one terminal to the other.

As best seen in FIG. 2 side wall 20 is formed with first and second pairs of upwardly extending channels 50,52 and 54,56. Channels 50,52 of the first pair are diametrically opposed to each other and are respectively aligned with the stationary contact members 36,38. Channels 54,56 of the second pair are also diametrically opposed to each other and are aligned with respective platforms 58 and 60.

An electrically conductive, flexible cruciform element 62 is received in housing 12 so that the distal end portions of first and second legs 64,66 extend respectively into channels 50,52 and the distal end portions of third and fourth legs 68,70 extend respectively into channels 54,56 and rest respectively on platforms 58,60. It will be seen that channels 54,56 cooperate with legs 68,70 of cruciform element 62 to maintain it in its desired alignment relative to the fixed contacts and the platforms. While the provision of channels is a convenient way to maintain the desired alignment since they can be included in the mold of the base member, it will be understood that equivalent location fixing means such as a cage receivable in the housing could be provided.

A shoulder 72 is formed in the free distal wall portion 20 to facilitate reception of a generally disk shaped pin guide 74. Pin guide 74 has a centrally located bore 76 extending therethrough which bore slidably receives motion transfer pin 78. Pin 78 extends between cruciform element 62 and snap acting member 80 disposed in housing 12. Snap acting member 80 is attached at its periphery to annular support member 82 which is used to adjust the release pressure calibration of member 82 as set forth in the above referenced patent as well as to prevent deleterious effects of over pressure on member 82. Housing 14, of any suitable weldable material, snap acting member 80, support 82 and ring 84 are welded along their outer periphery at 86 to form a hermetic seal. Ring 84 is crimped onto housing 12 as shown at 88 to fixedly mount housings 14 and 12 together. A conventional port fitting 16 having a central threaded bore 90 and communicating passage 92 is hermetically connected to housing 14 as be welding.

Thus snap acting member 80 can be brought into communication with a pressure source by attaching port fitting 16 to a port in a pressure line. As shown in FIG. 1 snap acting member 80 is in a normal, at rest convex configuration. Upon occurrence of a preselected condition, for instance a particular pressure level, member 80 will snap to a concave cofiguration with the central portion thereof moving closer to the switch mechanism. This motion is transferred to cruciform element 62 causing the central portion of element 62 to be depressed and contacts 94,96 fixed on respective distal end portion of first and second legs 64,66 to move into engagement respectively with stationary contacts 36,38 as seen in dashed lines in FIG. 1, closing an electric current path therebetween.

It will be seen that contacts 36,38 lie in a plane which is parallel to the plane in which the peripheral portion of member 80 lies.

Upon decrease of the source pressure below the calibrated release pressure snap acting member 80 will snap back to its convex configuration and the reaction of the distal end portions of legs 68,70 against respective platform surfaces 58,60 will cause contacts 94,96 to move into disengagement with the stationary contacts.

The device is easily assembled with identical terminals 26,28 inserted in their respective apertures 22,24 in molded base housing 12 and held in place by displacing tabs 40,42 and 44,46 or otherwise attaching by riveting, welding or the like. Cruciform element 62 is then dropped into place with legs 68,70 resting on their respective platform surfaces 58,60. Pin guide 74, which is preferably molded, is placed on shoulder 72 of wall 20 and pin 76 is dropped into bore 76 of guide 74. Finally the snap acting member housing 14 and port fitting 16 are placed over base housing 12 and crimped thereon.

Figure 3:
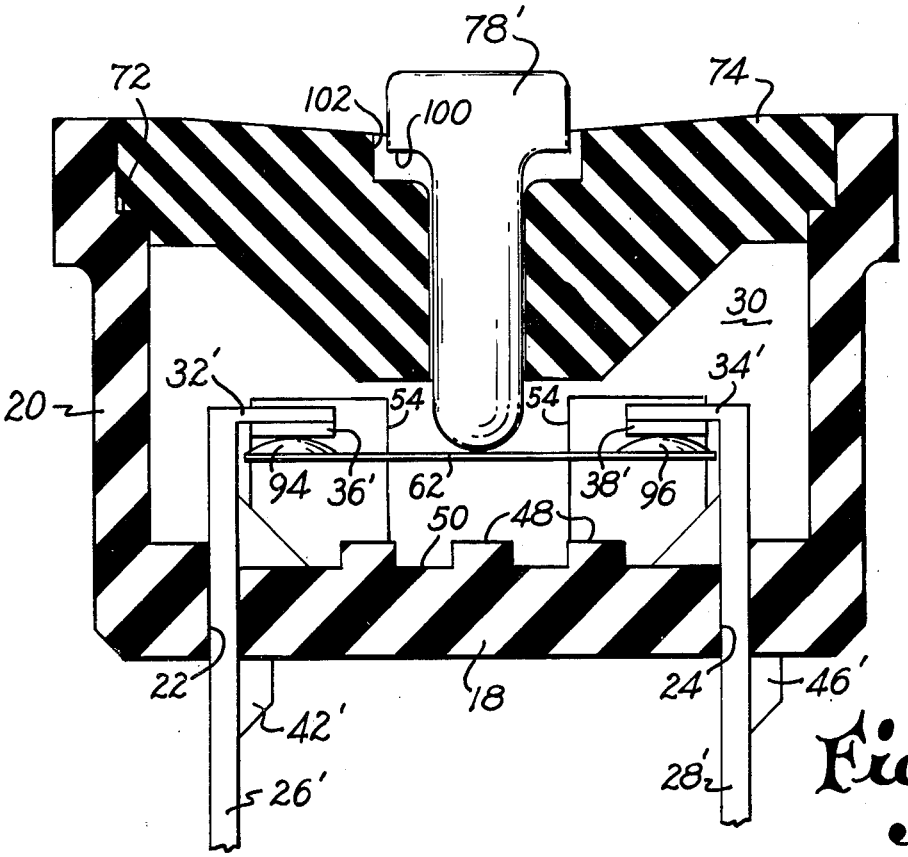
FIG. 3 is a vertical cross sectional view of the base housing portion and motion transfer mechanism of a second embodiment of the invention.

The device shown in FIG. 1 is a normally open electrical switch which is adapted to close upon a preselected increase in pressure. In that structure the stationary contacts are disposed at a distance from the snap acting member greater than the distance that cruciform element 62 is spaced from the snap acting member. However if it is desired to provide a normally closed electrical switch which opens upon a preselected increase in pressure stationary contacts 36,38 may be disposed at a distance from the snap acting member which is less than the distance that cruciform element 62 is spaced from snap acting member 80, as shown in FIG. 3. Thus terminals 26' and 28' extend into switch cavity 30 with contacts 36', 38' disposed on the lower surface of tab portions 32' 34' in contradistinction to the upper surfaces of tabs 32,34 in the FIGS. 1, 2 embodiment. Cruciform element 62 is inverted so that contacts 94,96 are disposed on the side toward snap acting member 80. Thus upon a pressure rise of a preselected level snapping of member 80 will cause legs 64,66 to move into disengagement with the stationary contacts and a decrease of pressure to the release level will cause legs 64,66 to move into engagement with the stationary contacts due to the reaction of legs 68,70 against the platform surfaces.

Also depicted in FIG. 3 is a modified motion transfer pin 78' which is formed with a shoulder 100 which has a diameter greater than the diameter of bore 76' which extends through motion transfer pin guide 74'. Guide 74' is provided with recessed area 102 which cooperates with shoulder 100 to prevent overtravel of pin 78'. Limiting travel of the motion transfer pin serves to mitigate over stress of cruciform member 62 by absorbing the metric energy in guide 74 rather than in cruciform element 62 and hence lengthens its useful life.

Figure 4:
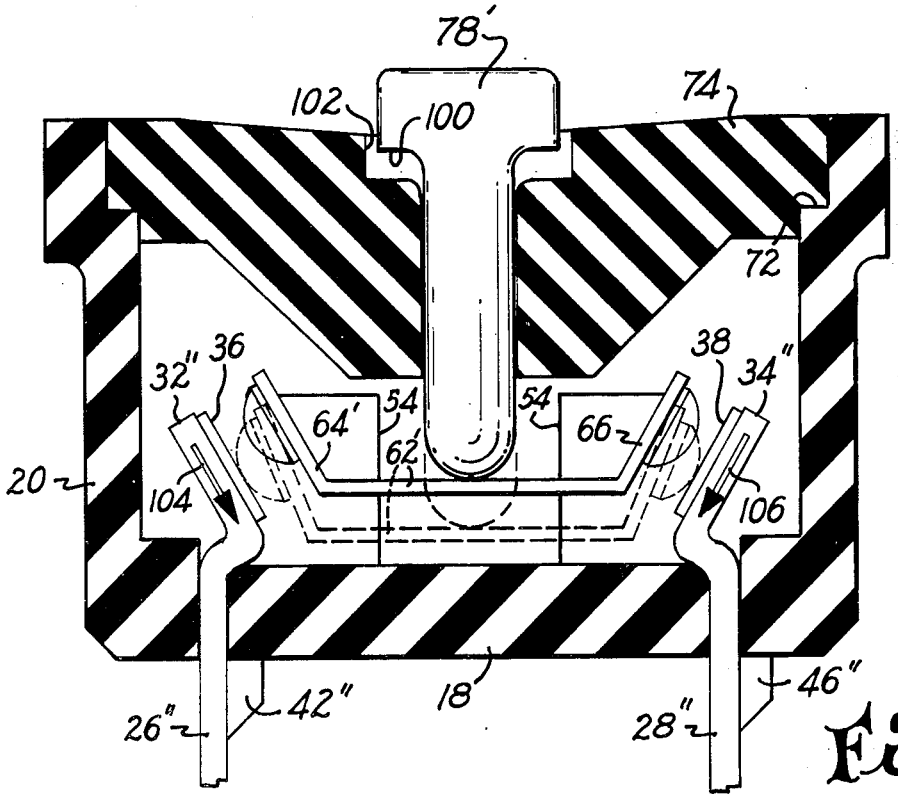
FIG. 4 is a vertical cross sectional view similar to FIG. 3 of another embodiment of the invention.

Yet another embodiment is shown in FIG. 4 in which contact wiping is enhanced. As seen in the figure contacts 36 and 38 of respective terminals 26" and 28" are disposed in planes which intersect each other and which form an actue angle with the plane in which the peripheral portion of the snap acting member lies. Terminals 26" and 28" are maintained in a desired fixed location by displacing respective tabs 42" and 46" away from the main body of their terminals. In this embodiment legs 64',66' are bent upwardly so that at their at rest configuration contacts 94,96 are disposed at angles conform generally to the stationary contacts. Thus as contacts 94 and 96 are brought into engagement and disengagement with stationary contacts 36 and 38 respectively the contact surfaces wipe against each other as indicated in FIG. 4 by arrows 104,106 with the solid line of cruciform element 62 indicating contact disengagement and dashed lines indicating contact engagement thereby maintaining the contact surface in a clean condition by wiping away arc contaminates which are deposited in the contact surfaces by the arcing which occurs on contact engagement and disengagement.

Figure 5:
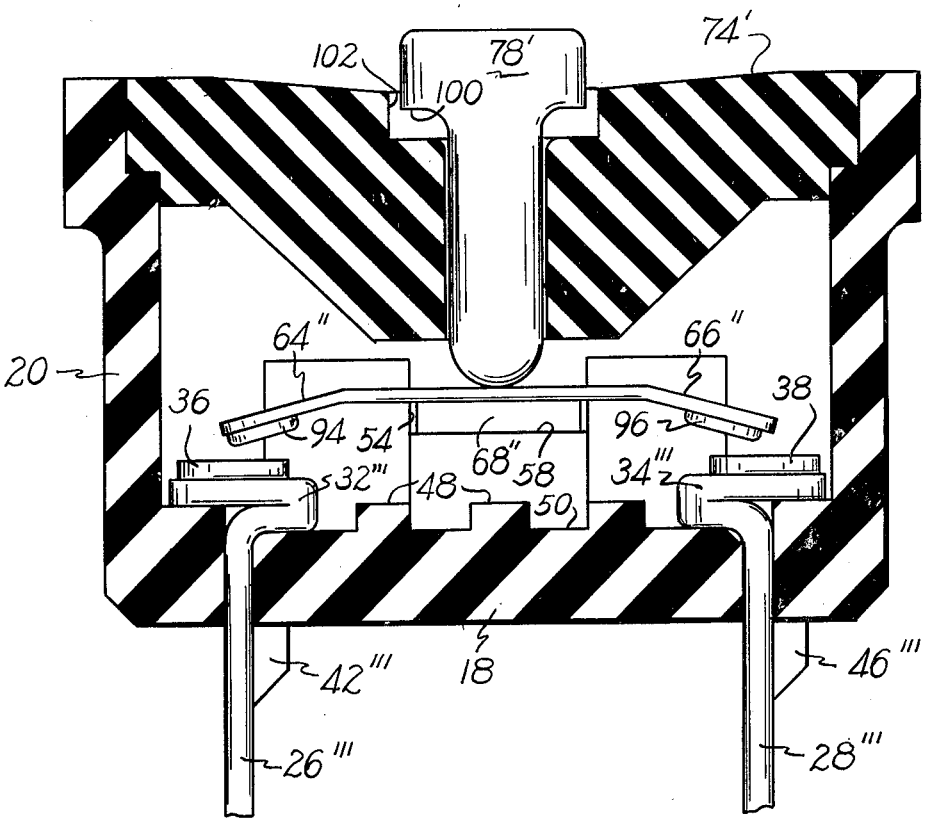
FIG. 5 is a vertical cross sectional view similar to FIG. 4 of yet another embodiment of the invention.
Figure 5A:
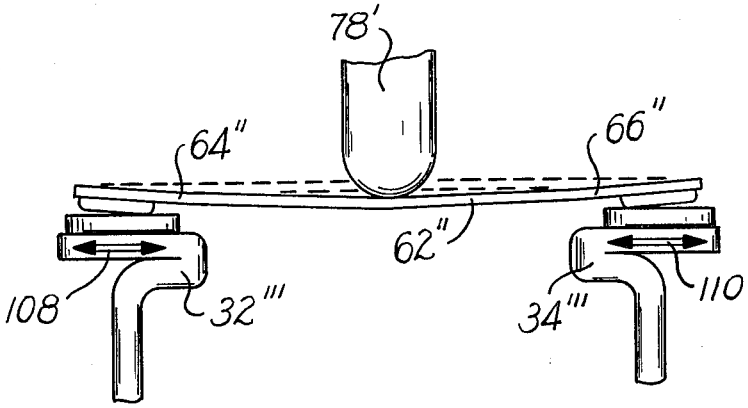
FIG. 5*a* is a view of a portion of FIG. 5 showing the contacts engaged postion of the cruciform element.

In FIG. 5 an embodiment is depicted which is especially effective in minimizing contamination of the contacts which contamination tends to occur particularly when direct current is switched due to the depositing effect of arcing. The legs of cruciform element 62'' are bent downwardly (only legs 64'',66'',68'' are shown in the figure) so that contacts 94,96 lie in planes which intersect each other as well as the plane in which stationary contacts 36 and 38 lie. Cruciform element 62'' is shown in FIG. 5 in the contacts disengaged position. As motion transfer pin 78' is depressed it causes the lowermost surface portions of contacts 94,96 to engage with respective stationary contacts 36,38. Continued downward motion of pin 78' causes contacts 94,96 to rock and slide, as will be apparent in FIG. 5*a*, thereby wiping away any arc contamination which may have been deposited on the contact surfaces. Since pin 78' strikes the cruciform element with significant inertia the center of element 62'' actually moves below the solid line position shown in FIG. 5*a* so the contacts slide beyond the position shown and then return to the at rest, contacts engages position shown in solid lines in the Figure. Thus upon contact engagement wiping of the contact surfaces occurs in two opposite directions as noted by arrows 108,110.

The increase in cycle life of a switch made in accordance with the invention in the order of 2.5 times over the conventionally mounted cantilever contact arm is made possible because the stress concentration on the movable contact arm are greatly reduced. That is, the movable contact arm of the present invention, rather than having a fixed end, is mounted as a simple plate with four areas of support.

Thus it will be seen that the invention provides a condition responsive electrical switch apparatus which has a markedly increased useful life expectancy while still being very simple, reliable and inexpensive to produce.

Various changes and modifications in the above described embodiments such as a change in the number of the reaction legs or contact legs of element 62 will be readily apparent to those skilled in the art and any of such changes or modifications are deemed to be within the spirit and scope of the present invention as set forth in the appended claims.

We claim:

1. Condition responsive switch apparatus comprising a housing, condition actuatable means mounted in the housing movable to and from first and second configurations upon the occurrence of preselected conditions, a pair of spaced stationary electrically conductive contact members disposed in the housing, an electrically conductive element having at least four legs, the first and second legs extending along one straight line and the third and fourth legs extending along another straight line, the straight lines intersecting one another, the first and second legs adapted to move into electrical engagement and disengagement with the pair of stationary contacts forming a closed circuit path between the stationary contacts when the element is in electrical engagement therewith and an open circuit path when the element is in disengagement therewith, reaction stop surfaces formed in the housing, the third and fourth legs having distal end portions disposed on the stop surfaces, the stop surfaces located in the housing such that a first force is exerted on the element tending to maintain the first and second legs in one of two positions of engagement and disengagement with the stationary contacts, the condition actuatable means adapted to exert a second force on the element when the condition actuatable means is in one of the first and second configurations larger than and opposing the first force so that the first and second legs are maintained in the other of the two positions of engagement and disengagement with the stationary contacts, when the condition actuatable means is in the other of its first and second configurations no second force is exerted on the element so that the first force maintains the first and second legs in the one of the two positions of engagement and disengagement with the stationary contacts.

2. Condition responsive apparatus according to claim 1 in which the element is generally cruciform in plan view and is formed of flexible material which has good spring characteristics.

3. Condition responsive apparatus according to claim 2 in which the condition actuatable means includes a snap acting membrane movable between first convex and second concave configurations, the second force exerted on the element when the membrane is in its second concave configuration, the first and second legs maintained in electrical engagement with the stationary contacts when the membrane is in its second concave configuration.

4. Condition responsive apparatus according to claim 2 in which the condition actuatable means includes a snap acting membrane movable between first concave and second concave configurations, the second force exerted on the element when the membrane is in its second concave configuration, the first and second legs maintained in electrical disengagement with the stationary contacts when the membrane is in its second concave configuration.

5. Condition responsive apparatus according to claim 2 in which the cruciform element lies in a plane and the first and second legs of the element are bent out of the said plane at its at rest configuration.

6. Condition responsive apparatus according to claim 2 in which the condition actuatable means includes a motion transfer pin and a generally disk shaped pin guide is disposed in the housing, the guide having a bore extending therethrough and the pin is slidably received in the bore.

7. Condition responsive apparatus according to claim 6 in which a shoulder is formed on an end of the pin so that motion of the pin is limited to thereby prevent overtravel of the pin upon movement of the actuatable means from one configuration to the other.

8. Condition responsive apparatus comprising a housing having a bottom wall and side walls extending upwardly therefrom to form a switch cavity therein, first and second spaced apertures extending through the bottom wall, terminals disposed in and extending through the apertures, stationary contacts mounted on the terminals within the housing, first and second pairs of upwardly extending channels formed in the side walls communicating with the switch cavity, the first pair of channels aligned with the stationary contacts, platforms formed in the side walls aligned with the second pair of channels, the platforms serving as stop surfaces, an electrically conductive, flexible cruciform element, distal end portions of two legs of the cruciform element extending into respective channels of the first pair, distal end portions of the other two legs of the cruciform element extending into respective channels of the second pair and disposed on the stop surfaces, and condition actuatable means closing the housing and adapted to place a force on the element in a direction toward the bottom wall upon the occurrence of preselected conditions.

9. Condition responsive apparatus according to claim 8 in which the platforms are disposed closer to the condition actuatable means than the stationary contacts.

10. Condition responsive apparatus according to claim 8 in which the platforms are disposed further from the condition actuatable means than the stationary contacts.

11. Condition responsive apparatus according to claim 8 in which the stationary contacts lie in planes which intersect each other.

12. Condition responsive apparatus according to claim 8 in which the condition actuatable means includes a pressure responsive, snap acting member, normally assuming a convex configuration, the member being movable upon the occurrence of a preselected pressure level from a convex to a concave configuration in which the central part of the member moves toward the bottom wall, and a motion transfer pin is disposed between the snap acting member and the cruciform element to transfer force from the snap acting member to the cruciform element.

13. Condition responsive apparatus according to claim 12 further including a generally disk shaped element received in the housing, the disk having a bore extending therethrough, the motion transfer pin slidably received in the bore and a shoulder is formed on the pin having a diameter larger than the diameter of the bore so that movement of the pin through the bore is limited.

14. Condition responsive apparatus comprising a generally open ended cup shaped housing of electrically insulating material, the housing having a bottom wall and side walls extending therefrom to form a switch cavity therein, first and second apertures extending through the housing walls, a terminal disposed in each aperture and extending therethrough, stationary contacts mounted on the terminals, bridging electrically conductive means adapted to move into engagement and disengagement with the stationary contacts to respectively close and open an electrical circuit therebetween, a condition responsive member, received on and closing the open end of the housing, the member is normally in a convex configuration and is movable upon the occurrence of a preselected condition from a convex to a concave configuration in which the central part of the member moves toward the bottom wall, motion transfer means adapted to transfer motion from the member to the bridging electrically conductive means, the bridging electrically conductive means contacting a portion of the housing and reacting against the housing to maintain the bridging electrically conductive means in disengagement with the stationary contacts when the member is in the convex configuration.

* * * * *